US006811204B2

(12) United States Patent
Long

(10) Patent No.: US 6,811,204 B2
(45) Date of Patent: Nov. 2, 2004

(54) ATV TOP

(76) Inventor: Jamie Long, 39 Carter Rd., Man, NY (US) 13661

( * ) Notice: Subject to any disclaimer, the term of this patent is extended or adjusted under 35 U.S.C. 154(b) by 0 days.

(21) Appl. No.: 10/657,330

(22) Filed: Sep. 8, 2003

(65) Prior Publication Data

US 2004/0050410 A1 Mar. 18, 2004

Related U.S. Application Data

(60) Provisional application No. 60/319,552, filed on Sep. 15, 2002.

(51) Int. Cl.[7] ..... B60J 7/10

(52) U.S. Cl. ..... 296/102; 296/79; 135/88.05

(58) Field of Search ..... 296/102, 77.1, 296/79, 159; 135/88.05, 88.13, 88.15

(56) References Cited

U.S. PATENT DOCUMENTS 4,657,299 A * 4/1987 Mahan ..... 296/159
4,950,017 A * 8/1990 Norton ..... 296/77.1
6,206,446 B1 3/2001 Slayden
6,402,220 B2 6/2002 Allen
6,543,830 B1 4/2003 Stuck
6,565,139 B2 5/2003 Bayerle et al.

* cited by examiner

*Primary Examiner*—Dennis H. Pedder

(57) ABSTRACT

An ATV enclosure includes a plurality of first elongate support members positionable adjacent front and rear corners of an ATV and overlap each other generally medially between the opposed end portions, respectively. The ATV enclosure further includes a plurality of second support members having opposed end portions removably connectable adjacent to front and rear corners of an ATV. The ATV enclosure further includes a cover attachable to a plurality of receiving members and is positionable above the plurality of first support members for defining a cavity therebeneath and for protecting an operator from the environment. The cover includes a body preferably including a ventilation portion formed therein and for allowing air to pass therethrough. The body may further include a plurality of access panels formed therein and a plurality of zippers attached thereto, respectively, for adjustably opening and closing same. A plurality of fastening members help secure the enclosure to an ATV.

18 Claims, 4 Drawing Sheets

ATV TOP

CROSS REFERENCE TO RELATED APPLICATIONS

This application claims the benefit of U.S. Provisional Application No. 60/319,552, filed Sep. 15, 2002 and titled "ATV TOP", which refers to Disclosure Document Paper No. 498318 deposited on Aug. 13, 2001 at the USPTO.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a removable enclosure for an all terrain vehicle (ATV) and, more particularly, to an ATV enclosure which is readily and easily deployable between operating and non-operating positions.

2. Prior Art

People typically use ATVs as a mode of transportation or a recreational vehicle. Individuals often use ATVs during hunting, ice fishing, and other outdoor activities. The smaller size and compactness of an ATV allows users, including hunters and campers to reach secluded areas not normally accessible by cars and trucks. Additionally, the design of ATVs allows users to maneuver rugged terrain not easily reached by other vehicles or hiking and more easily and quickly reached by an ATV.

The ATV also aids the user by carrying equipment and allowing the user to ride to the desired location. ATVs are also useful for ice fishing to carry individuals and their equipment to the designated fishing spot. ATVs are lighter than other vehicles, such as cars and trucks, used to reach fishing spots thereby having a lower risk of falling through the ice.

Hunting and ice fishing typically occur during the fall and winter months when inclement weather and harsh weather conditions exist. Users and the ATV will often need to be protected from the weather. Campers will also need an area to setup camp, a place to eat, and rest. The compact size of the ATV limits the amount of equipment an individual can carry. Furthermore, because of the transitory nature of hunting and ice fishing, any shelter an individual uses should allow for quick and easy setup and take down.

Accordingly, there exists a need to provide an enclosure for mounting to an ATV that is portable, easy to setup and take down by its user, and provides an area for the user to hunt, fish, rest or camp.

BRIEF SUMMARY OF THE INVENTION

In view of the foregoing background, it is therefore an object of the present invention to provide a portable ATV enclosure that can be easily installed without requiring tools. These and other objects, features, and advantages of the invention are provided by an ATV enclosure including a plurality of first elongate support members having opposed end portions respectively positioned adjacent front and rear corners of an ATV. The plurality of first support members extend upwardly from front and rear corners of an ATV and overlap each other generally medially between the opposed end portions, respectively. The plurality of first support members are preferably substantially flexible and may be formed from fiberglass material, for example.

The ATV enclosure further includes a plurality of second elongate support members having opposed end portions removably connectable adjacent to front and rear corners of an ATV. The plurality of second support members have adjustable lengths, respectively, for being positioned generally between the opposed end portions of the plurality of first support members. The plurality of second support members each further has a centrally disposed longitudinal axis and may be telescopically extendable along therealong.

The ATV enclosure further includes a plurality of receiving members attachable adjacent to an ATV and for receiving the opposed end portions of the plurality of first support members, respectively. The plurality of receiving members are preferably adjustable for allowing the plurality of first support members to be selectively positionable therein. The ATV enclosure further includes a plurality of elongate fastening members having opposed end portions attachable to an ATV and the plurality of second support members, respectively, so that same can be maintained in a substantially secure position during operating conditions. The plurality of fastening members have opposed end portions and preferably include a plurality of hooks attached thereto, respectively.

The ATV enclosure further includes a cover attachable to the plurality of receiving members and positionable above the plurality of first support members for defining a cavity therebeneath and for protecting an operator from the environment. The cover includes a body preferably including a ventilation portion formed therein and for allowing air to pass therethrough. The ventilation portion may include a top surface formed from mesh material. Advantageously, mosquitoes and the like are prevented from entering the cavity of the cover while air is allowed to circulate therein. The body may further include a plurality of openings defined therein and for allowing an operator to view therethrough. Alternately, the body may include a plurality of access panels formed therein and including a plurality of zippers, respectively, for adjustably opening and closing same.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
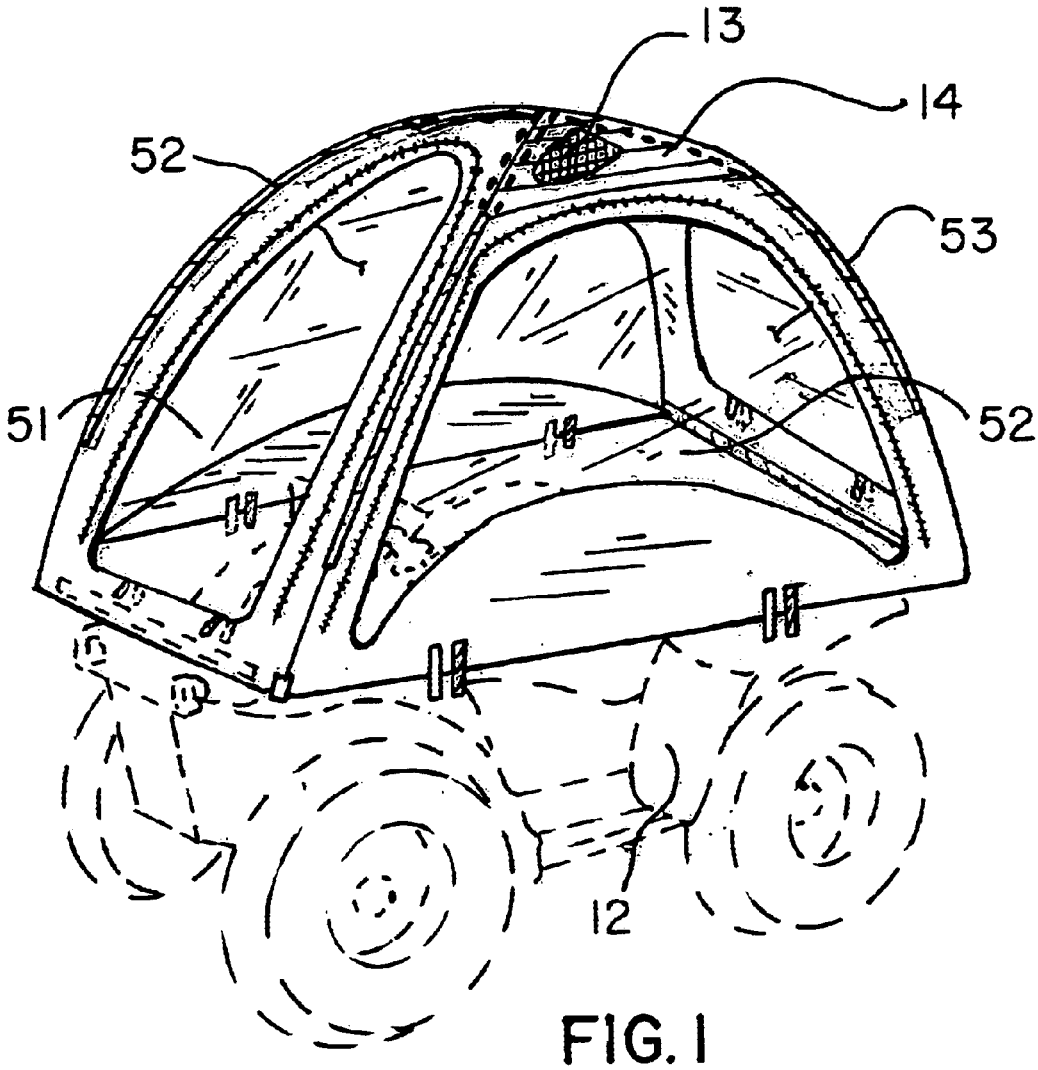
FIG. 1 is a perspective view showing an ATV enclosure mounted on a conventional ATV, in accordance with the present invention.

The apparatus of this invention is referred to generally in FIG. 1 by the reference numeral 10 and is intended to provide a flexible enclosure for an all terrain vehicle (ATV). It should be understood that the apparatus 10 may be employed by various ATVs that include front and rear racks, as well known in the industry. Applicant's Provisional Application No. 60/319,552, filed Sep. 15, 2002 and titled "ATV TOP", is incorporated herein by reference.

The apparatus 10 includes a cover 65 preferably made from waterproof material such as canvas and nylon, for example. The cover 65 is self-standing, with no permanent attachment to the ATV 12. The cover 65 has front 51, side 52, and rear 53 clear poly-windows. The front 51 and rear 52 windows each have an oval shaped access door 16, which can be opened and closed via zipper 22, as perhaps best shown in FIGS. 7 and 8. Advantageously, an operator may access the front and rear racks while seated within the enclosure 10.

Figure 2:
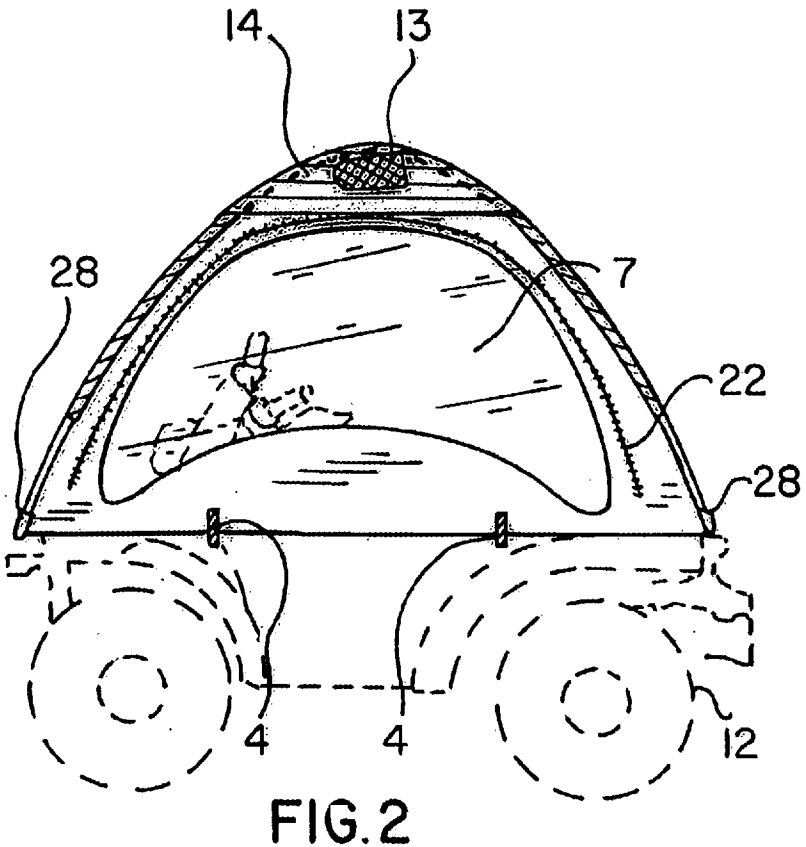
FIG. 2 is side elevational view of the apparatus shown in FIG. 1.
Figure 8:
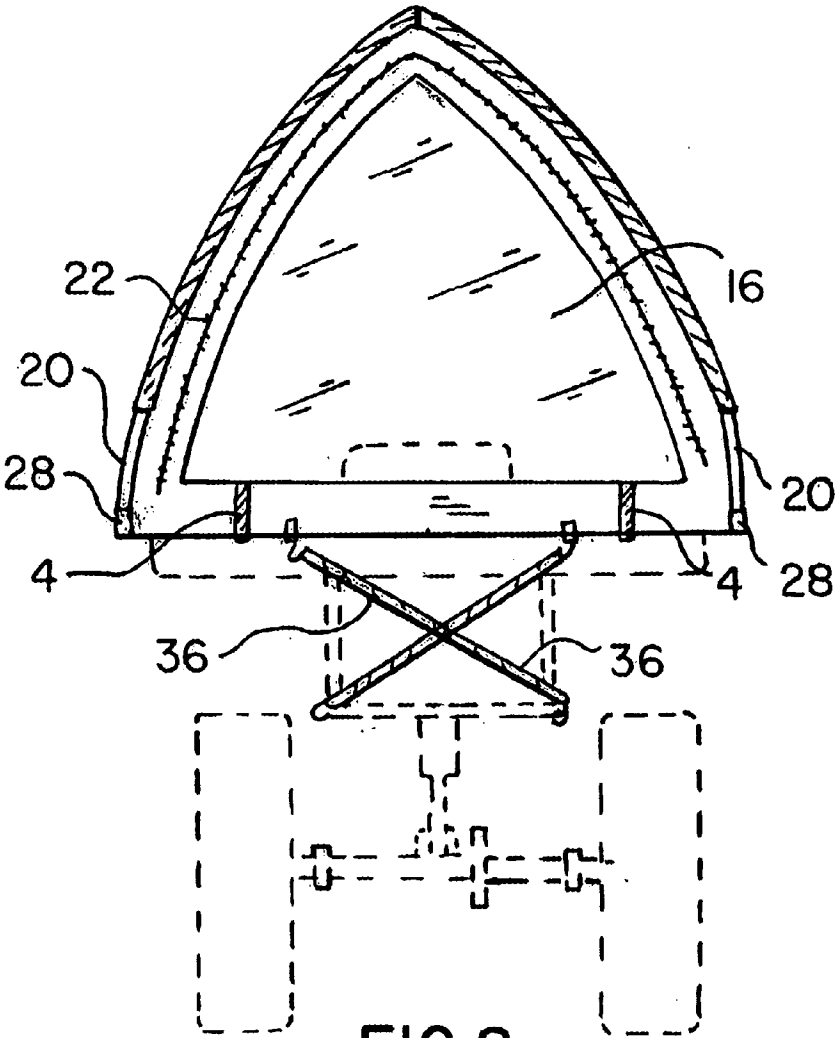
FIG. 8 is a rear elevational view of the apparatus shown in FIG. 1.
Figure 7:
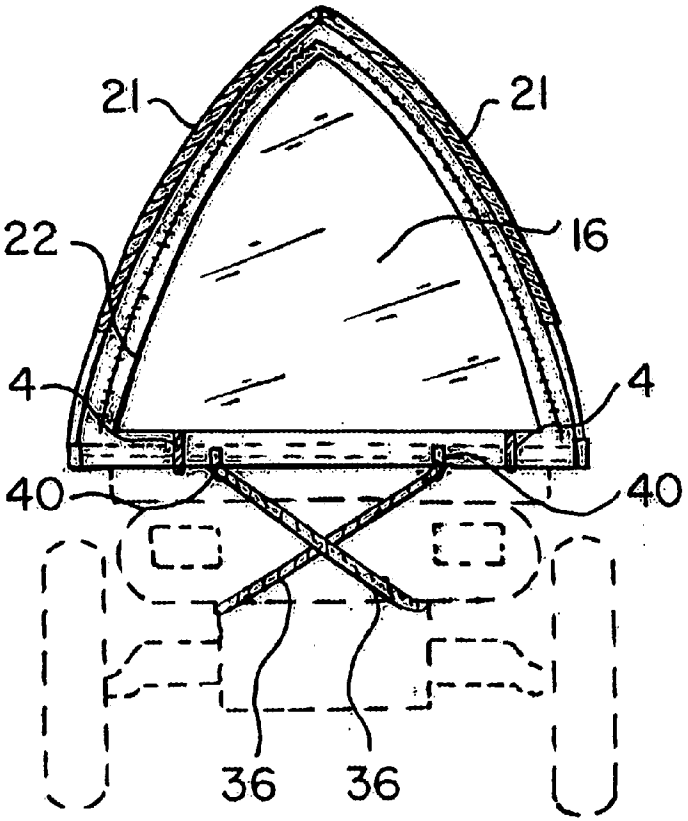
FIG. 7 is a front elevational view of the apparatus shown in FIG. 1.

Now referring to FIG. 2, both sides of the cover 65 has a half-moon shaped zipper 22 and access door 57 for entering the enclosure 10, as needed. Referring to FIGS. 2, 7 and 8, the zipper doors 57, 16 roll down and are held by Velcro straps 54, when the doors are open. The top of the cover 65 includes two ventilation screens 13, as perhaps best shown in FIGS. 1 and 2. A canopy-style cover 14 is attached to the top of the screens 13, to keep the elements out of the enclosure 10.

Figure 4:
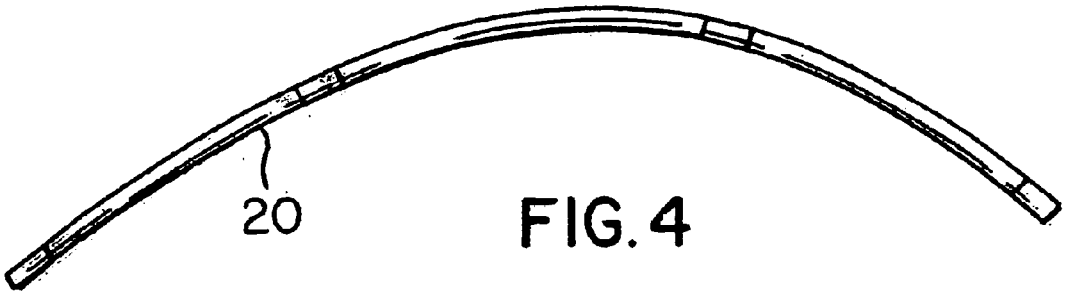
FIG. 4 is a perspective view showing a flexible support member for defining the structure of the present invention.

Now referring to FIGS. 1 and 4, a pair of expandable fiberglass poles 20 extend from opposed ends of the ATV and overlap each other for forming the dome-like shape of the enclosure 10. In particular, the fiberglass poles 20 are positioned through two sheaths 21, as perhaps best shown in FIG. 7, and extend upwardly and away between oppositely spaced bottom corners of the ATV, as clearly shown. Such poles 20 overlap generally medially between their opposed end portions and form an apex above an operator's seat.

Figure 5:
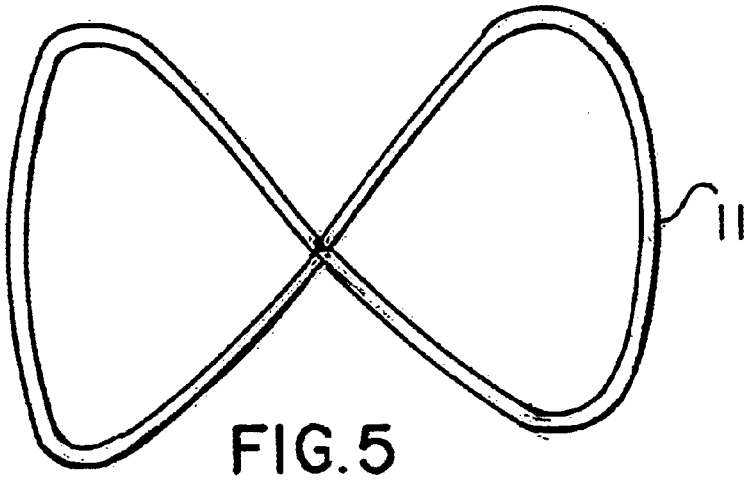
FIG. 5 is a perspective view showing an alternate embodiment of a flexible support member.
Figure 6:
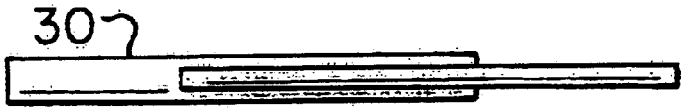
FIG. 6 is a side elevational view showing an adjustable support member for attaching to the flexible support members shown in FIG. 5.

Referring to FIGS. 2, 4 and 8, the opposed end portions of the fiberglass poles 20 are disposed into cups 28, which are positioned at each bottom corner of the cover 65. In an alternate embodiment, the dome-like shape of the enclosure 10 may be formed by an adjustable spring-frame 11, as shown in FIG. 5. Such a spring-frame 11 may be permanently sewn to the cover 65. The bottom portion 60 of the cover 65 is formed from a durable and rip-stop material, as well known to a person of ordinary skill in the art. Such a bottom portion 60 has a diamond shaped hole 23 formed therein, and disposed substantially medially about the operator's seat. The hole 23 allows an operator to quickly and easily position the cover 65 over the ATV handlebars and seat. Of course, the rip-stop material can be trimmed to accommodate various shaped ATVs. An additional piece of rip-stop material may be attached via Velcro to the inside bottom portion of the cover 65, when being used as a shelter.

Figure 3:
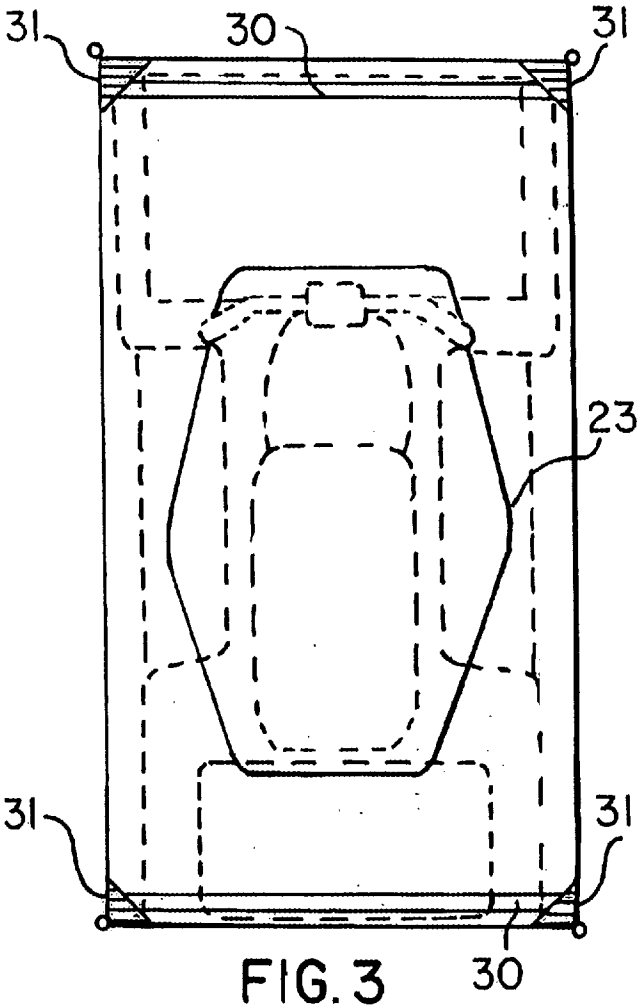
FIG. 3 is a top plan view of the apparatus shown in FIG. 1.

Now referring to FIGS. 1, 2, 6, 7 and 8, the cover 65 is mounted to the ATV by a pair of poles 30 that are adjustable in length. Such poles 30 are disposed on the inside portion of the cover 65, one across the inside front bottom edge and one across the inside back bottom edge of the cover 65. Such poles 30 are placed into cups 31, as perhaps best shown in FIG. 3, which are disposed at the inside corners of the cover 65 to thereby spread same across the body of the ATV so that the cover 65 is able to maintain a rigid shape.

Four stretch cords 36, as best shown in FIGS. 7 and 8, are removably attachable to poles 30 and the ATV so that the cover 65 can be securely maintained in position during operating conditions. In particular, two stretch cords 36 secure the front of the cover 65 to the ATV and two stretch cords 36 secure the rear of the cover 65 to the ATV. One end portion of such stretch cords 36 hook to the rigid poles 30, through a hole 40 formed therein, as perhaps best shown in FIG. 7. Such holes 40 are disposed at the bottom portion of the rip stop material between oppositely spaced corners thereof. The opposite end portions of the stretch cords 36 are removably attachable to suitable front and rear portions of the ATV so that sufficient tension is maintained to hold the cover 65 in place. Advantageously, each pair of front and rear stretch cords 36 overlap each other for providing additional stability during operating conditions.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An ATV enclosure comprising:

a plurality of first elongate support members having opposed end portions respectively positioned adjacent front and rear corners of an ATV, said plurality of first support members extending upwardly from front and rear corners of an ATV and overlapping each other generally medially between said opposed end portions respectively;

a plurality of second elongate support members having opposed end portions removably connectable adjacent to front and rear corners of an ATV, said plurality of second support members having adjustable lengths respectively and for being positioned generally between said opposed end portions of said plurality of first support members respectively;

a plurality of receiving members attachable adjacent to an ATV and for receiving said opposed end portions of said plurality of first support members respectively, a plurality of elongate fastening members having opposed end portions and being attachable to an ATV and said plurality of second support members respectively so that same can be maintained in a substantially secure position during operating conditions; and a cover being attachable to said plurality of receiving members and being positionable above said plurality of first support members for defining a cavity therebeneath and for protecting an operator from the environment.

2. The ATV enclosure of claim 1, wherein said plurality of first support members are formed to be substantially flexible.

3. The ATV enclosure of claim 1, wherein said plurality of first support members are formed from fiberglass material.

4. The ATV enclosure of claim 1, wherein said plurality of second support members each have a centrally disposed longitudinal axis, said plurality of second support members are telescopically extendable along the respective longitudinal axis.

5. The ATV enclosure of claim 1, wherein said plurality of fastening members have opposed end portions and comprise a plurality of hooks attached thereto respectively.

6. The ATV enclosure of claim 1, wherein said cover comprises a body having a plurality of openings defined therein and for allowing an operator to view therethrough.

7. The ATV enclosure of claim 1, wherein said cover comprises a body including a plurality of access panels formed therein, said plurality of access panels including a plurality of zippers respectively for adjustably opening and closing same.

8. The ATV enclosure of claim 1, wherein said cover comprises a body including a ventilation portion formed therein and for allowing air to pass therethrough, said ventilation portion including a top surface formed from mesh material.

9. An ATV enclosure comprising:

a plurality of first elongate support members having opposed end portions respectively positioned adjacent front and rear corners of an ATV, said plurality of first support members extending upwardly from front and rear corners of an ATV and overlapping each other generally medially between said opposed end portions respectively, said plurality of first support members are formed to be substantially flexible;

a plurality of second elongate support members having opposed end portions removably connectable adjacent to front and rear corners of an ATV, said plurality of second support members having adjustable lengths respectively and for being positioned generally between said opposed end portions of said plurality of first support members respectively, said plurality of second support members each have a centrally disposed longitudinal axis, said plurality of second support members are telescopically extendable along the respective longitudinal axis;

a plurality of receiving members attachable adjacent to an ATV and for receiving said opposed end portions of said plurality of first support members respectively, a plurality of elongate fastening members having opposed end portions and being attachable to an ATV and said plurality of second support members respectively so that same can be maintained in a substantially secure position during operating conditions; and a cover being attachable to said plurality of receiving members and being positionable above said plurality of first support members for defining a cavity therebeneath and for protecting an operator from the environment.

10. The ATV enclosure of claim 9, wherein said plurality of first support members are formed from fiberglass material.

11. The ATV enclosure of claim 9, wherein said plurality of fastening members have opposed end portions and comprise a plurality of hooks attached thereto respectively.

12. The ATV enclosure of claim 9, wherein said cover comprises a body having a plurality of openings defined therein and for allowing an operator to view therethrough.

13. The ATV enclosure of claim 9, wherein said cover comprises a body including a plurality of access panels formed therein, said plurality of access panels including a plurality of zippers respectively for adjustably opening and closing same.

14. The ATV enclosure of claim 9, wherein said cover comprises a body including a ventilation portion formed therein and for allowing air to pass therethrough, said ventilation portion including a top surface formed from mesh material.

15. An ATV enclosure comprising:

a plurality of first elongate support members having opposed end portions respectively positioned adjacent front and rear corners of an ATV, said plurality of first support members extending upwardly from front and rear corners of an ATV and overlapping each other generally medially between said opposed end portions respectively, said plurality of first support members are formed to be substantially flexible;

a plurality of second elongate support members having opposed end portions removably connectable adjacent to front and rear corners of an ATV, said plurality of second support members having adjustable lengths respectively and for being positioned generally between said opposed end portions of said plurality of first support members respectively, said plurality of second support members each have a centrally disposed longitudinal axis, said plurality of second support members are telescopically extendable along the respective longitudinal axis;

a plurality of receiving members attachable adjacent to an ATV and for receiving said opposed end portions of said plurality of first support members respectively, a plurality of elongate fastening members having opposed end portions and being attachable to an ATV and said plurality of second support members respectively so that same can be maintained in a substantially secure position during operating conditions, said plurality of fastening members have opposed end portions and comprise a plurality of hooks attached thereto respectively; and a cover being attachable to said plurality of receiving members and being positionable above said plurality of first support members for defining a cavity therebeneath and for protecting an operator from the environment, said cover comprises a body including a ventilation portion formed therein and for allowing air to pass therethrough, said ventilation portion including a top surface formed from mesh material.

16. The ATV enclosure of claim 15, wherein said plurality of first support members are formed from fiberglass material.

17. The ATV enclosure of claim 15, wherein said body has a plurality of openings defined therein and for allowing an operator to view therethrough.

18. The ATV enclosure of claim 15, wherein said body comprises a plurality of access panels formed therein, said plurality of access panels including a plurality of zippers respectively for adjustably opening and closing same.

* * * * *

UNITED STATES PATENT AND TRADEMARK OFFICE

CERTIFICATE OF CORRECTION

PATENT NO. : 6,811,204 B2
DATED : November 2, 2004
INVENTOR(S) : Jamie Long

It is certified that error appears in the above-identified patent and that said Letters Patent is hereby corrected as shown below:

Title page,
Item [75], Inventor, correct name of inventor to: -- Jamie DeLong --

Signed and Sealed this

First Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,811,204 B2 
DATED : November 2, 2004
INVENTOR(S) : Jamie Delong

It is certified that error appears in the above-identified patent and that said Letters Patent is hereby corrected as shown below:

Title page,
Item [76], Inventor, city of inventor should be -- Mannsville --

Signed and Sealed this

Twenty-second Day of February, 2005

JON W. DUDAS
*Director of the United States Patent and Trademark Office*